United States Patent [19]

Lippolt

[11] Patent Number: 4,497,352

[45] Date of Patent: Feb. 5, 1985

[54] ADJUSTABLE VIOLIN PEG AND DOWEL SHAVING DEVICE

[76] Inventor: Paul K. Lippolt, 6128 N. Willston Dr., Falls Church, Va. 22044

[21] Appl. No.: 492,957

[22] Filed: May 9, 1983

[51] Int. Cl.[3] ..... B27C 7/06

[52] U.S. Cl. ..... 142/48; 142/56; 144/4; 144/365

[58] Field of Search ..... 144/4, 365; 142/48, 142/56

[56] References Cited

U.S. PATENT DOCUMENTS

| | | | |
|---|---|---|---|
| 14,173 | 1/1856 | Webber | 142/48 |
| 68,064 | 8/1867 | Gifford | 142/48 |
| 245,233 | 8/1881 | Sillman | 142/48 |

*Primary Examiner*—W. D. Bray

*Attorney, Agent, or Firm*—James C. Wray

[57] ABSTRACT

An adjustable Violin Peg and Dowel Shaving Device capable of shaving a tapered or non-tapered peg or dowel from a size substantially that of a full size cello peg down to almost the size of a toothpick with only one adjustment. The device comprises two guide bolts each extending along an axis through bores in two substantially rectangular blocks, the first block being secured to the guide bolts and having a V-shaped groove in one side facing the second block, and whereby the second block is movable along said guide bolts having a taper adjusting cutterblade mounted thereon. Two adjusting nuts threadedly received by said guide bolt ends rotatably advance said movable block toward said V-shaped groove which accommodates a peg or dowel for shaving.

9 Claims, 4 Drawing Figures

ADJUSTABLE VIOLIN PEG AND DOWEL SHAVING DEVICE

BACKGROUND OF THE INVENTION

This invention relates to a shaving device for violin pegs, dowels, and the like, and in particular to one which is adjustable.

Violin peg shaving devices have been in use for hundreds of years. These devices have in the past been of non-adjustable type more suitable for violin making rather than for their repair. Shaving a peg to a fixed size and taper for manufacture by use of a non-adjustable unit is preferred, but in repair or replacement the pegs periodically, throughout the life of the violin, need reshaping or resizing to fit larger worn peg holes. In addition to violin peg shaving, many violins are constructed and or repaired with the use of small tapered or non-tapered dowels. This invention may also be handy around the shop for other dowelling and peg uses such as; for constructing jigs, tools, or even repair of furniture.

It is the purpose of this invention to provide an efficient device whereby size and taper are adjustable for shaving violin, viola, and cello pegs, or dowels and the like.

The essence of this invention lies in the adjustability of the device, whereby certain embodiments cooperate angularly in their relationship.

These and other objects of this invention will become more apparent in the following detailed specification taken with reference to the accompanying drawings.

SUMMARY OF THE INVENTION

In the present invention, a stationary block and a movable block form a vice-like apparatus by means of two guide bolts passing longitudinally through each block in spaced parallel relationship to each other. Headed portions of the guide bolts secure the stationary block to the guide bolts while opposite threaded portions slidably receive the movable block and threadedly engage nuts so that axially advancing the nuts toward the headed portions causes axial movement of the movable block toward the stationary block.

In a side of the stationary block facing the movable block, there is provided a generally V-shaped groove. The groove appears V-shaped in cross section but comprises two planar surfaces meeting and forming the vertex of the "V" and also forming a right angle. One planar surface is more acutely angled than the other in relation to the longitudinal axis of the stationary block. The groove receives a dowel prior to shaving.

The movable block has a cutterblade mounted to an upper surface. The cutterblade has two elongated apertures or slots provided for screws which pass through the slots and fasten to the movable block. The cutterblade has a beveled edge forming a point along its upper surface, the edge being generally parallel to the V-shaped groove and the pointed edge being axially in line with the vertex of the "V".

The edge holds the dowel into the V-shaped groove and also performs the shaving function by axially advancing the movable block via the guidebolts and nuts. When the dowel is secured in the groove, it is rotated against the beveled edge of the cutterblade and thereby shaven to reduce its diameter.

The fact that the groove actually comprises two right angled planar surfaces encourages the dowel to remain centered between the surfaces during rotation.

If tapering is desired, the cutterblade can be adjusted by moving one screw forward or backward in its respective slot while holding the other screw in place, or moving it oppositely from the other screw. This allows the edge to be angled in relation to the V-shaped groove.

DETAILED DESCRIPTION OF THE DRAWINGS

Figure 1:
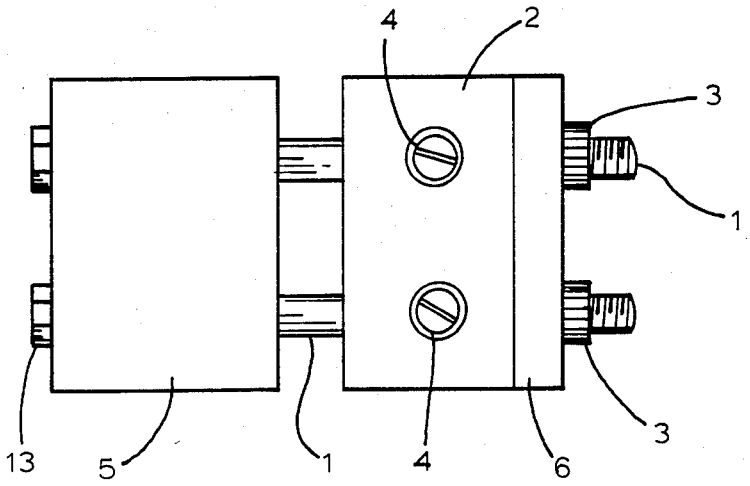
FIG. 1 Is a top view of the shaving device
Figure 2:
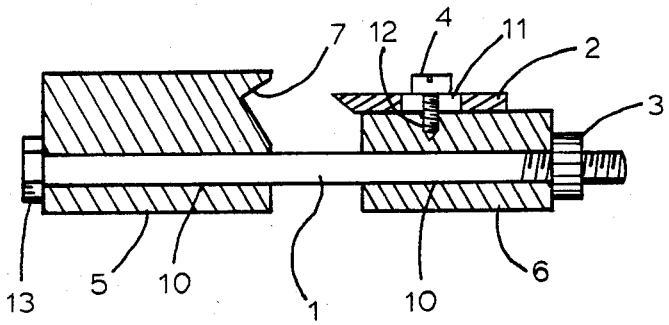
FIG. 2 Is a cross sectional side view showing embodiments thereof in relationship.
Figure 4:
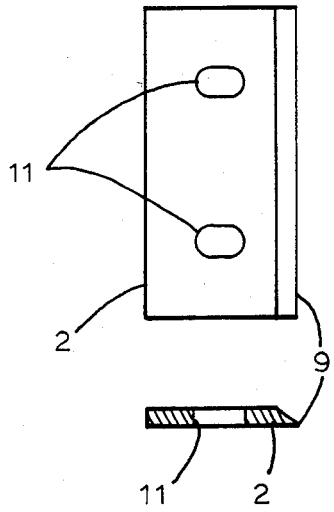
FIG. 4 Is a top and side view of a cutterblade.

In FIGS. 1 and 2 a shaving device for violin pegs, dowels and the like has two guide bolts 1 each of a round section having first and second ends, wherein the first end is a head 13, and the second threaded to receive adjusting nuts 3. The shank, intermediate the bolt head 13 and the threads, is smooth. Each guide bolt 1 extends along an axis through bores 10 in two substantially rectangular blocks 5,6, whereby one block 5 is stationary by means of the guide bolts 1 being secured to it at the head ends of the bolts 1, and the other block 6 being moveable along the guide bolts 1 from their threaded ends.

The stationary block 5 has a V-shaped groove 7 extending across its side facing the movable block 6, and where the guide bolts 1 are extending therefrom to accomodate the movable block 6.

A cutterblade 2 is mounted atop the movable block 6, and has a beveled cutting edge 9 being sharpened angular to a point along the upper surface of the cutterblade, and two slots 11 are spaced through the center of the cutterblade 2 adjacent from and perpendicular to the cutting edge 9. The cutterblade 2 is mounted by means of two securing screws 4 passing through the two slots 11 and are threadingly secured into two holes 12 in the block 6. The cutterblade edge 9 is mounted slightly overhanging the edge of the block 6 facing the stationary block 5 and V-shaped groove 7.

The cutterblade 2 is responsible for holding the peg in the V-shaped groove 7 as well as shaving it, therefore the effectiveness of the shaving process depends largely upon the cutterblade edge 9. A preferred angle of approximately thirty five degrees is desired along with the fact that if the cutting edge 9 is too sharp it may only stick in the peg or tear it limiting effective shaving, whereas if the cutting edge 9 is slightly dull its' effectiveness is greatly increased. Heretofore the quality of the cutting edge 9 is now a factor, whereby it is preferred that the cutterblade 2 be of a substantially hard material such as; chrome steel or chrome vanadium, and tempered for increased hardness.

Figure 3:
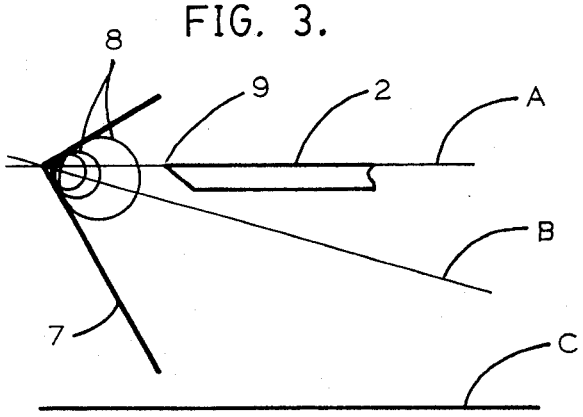
FIG. 3 Is an illustration of certain embodiments angularly in their relationship.

Even though one of the successes of the present invention is of the cutterblade nature and design, the true essence of this invention, and principal on which it was founded, lies in the certain embodiments of the device being at certain angles in their relationship. In examination of (FIG. 3) the V-shaped groove 7 is accomodating a peg or dowel 8. A plane is established fron the cutterblade edge 9 to the vertex of the V-shaped groove 7.

This is the guide plane A which is parallel to the guide bolt axis C. The V-shaped groove 7 forming a right angle, is bisected from its' vertex. The plane B of this bisected angle should be substantially lower than the guide plane A and more ideally at an angle of approximately fifteen degrees to the axis of the guide bolt C.

To set the taper for a peg or dowel the cutterblade 2 may be adjusted by loosening the cutterblade securing screws 4 and moving one or the other of its' ends closer to the stationary block 5 and V-shaped groove 7. This is possible by means of the slots 11 in the cutterblade 2 allowing slight turnable movement. It is possible for this device to be operated by either a left handed or right handed operator simply by selecting the desired direction of taper and by inserting the peg in the vee groove 7 from either respective side of the device.

Turning one or both adjusting nuts 3 advances the movable block 6 along the guide bolts 1 toward the peg 8 mounted in the V-shaped groove 7. The cutterblade 2 contacting the peg 8 for shaving process holds the peg 8 in place in the V-shaped groove 7. This process causes a force outwardly on both blocks 5,6. The force against the movable block 6 is stopped by the adjusting nuts 3, whereby the force against the stationary block 5 is stopped either by the guide bolt heads 13 or the securing of the guide bolts 1 to the stationary block 5. Rotating the peg 8 shaves it to the pre-adjusted taper and by turning the adjusting nuts 3 the size of the tapered peg is reduced. As the peg 8 is reduced in size by the shaving process its' axis travels toward the vertex of the V-shaped groove 7 along the bisected angle plane B, and at the same time the cutting edge 9 travels toward the same vertex along the guide plane A. These angles in their relationship to the certain embodiments herein enable the cutting edge 9 to remain in the same position of radius on the peg 8 from the peg axis, which effects the performance of the device which in turn enables a peg or dowel to be shaved in size accurately from that substantially of a full size cello peg down to almost toothpick size with only one adjustment.

The present invention herein illustrated is non-limiting and is obvious to those skilled in the art that various minor changes can be made without departing from the concept of this invention and all such as fall within the reasonable scope of the appended claims as claimed.

What is claimed is:

1. A violin peg and dowel shaving device comprising two guide bolts threaded at one end to receive adjusting nuts, each extending along an axis through bores in two substantially rectangular blocks, one block being stationary by means of said guide bolts being fixedly secured to it, and the other being movable along said guide bolts from their threaded ends, the stationary block having a V-shaped groove extending across on its side facing said movable block, and a cutterblade being mounted by means of two securing screws, each screwable into threaded bores atop said movable block, the cutterblade having a beveled edge facing stationary block.

2. The peg and dowel shaving device of Claim 1 wherein a plane established from the cutting edge of said cutterblade to the vertex of said V-shaped groove defines a guide plane which is parallel to a guide bolt axis, and wherein said V-shaped groove forms a right angle which is bisected, the plane of this bisection being substantially lower than said guide plane at an angle to the axis of said guide bolts.

3. The apparatus of claim 1, wherein the guide bolts have headed portions at one end smooth cylindrical mid portions and threaded opposite end portions to receive the said adjusting nuts.

4. The peg and dowel shaving device of claim 1 wherein the cutterblade has two parallel slots arranged perpendicular to the beveled edge for receiving the two securing screws, the slots providing angular adjustment of the cutterblade relative to the V-shaped groove.

5. The peg and dowel shaving device of claim 1 wherein the beveled edge overhangs a side of the movable block facing the stationary block.

6. The peg and dowel shaving device of claim 1 wherein the beveled edge of the cutterblade is axially aligned with a vertex of the V-shaped groove.

7. The peg and dowel shaving device of claim 1 wherein the V-shaped groove comprises two right-angled planar surfaces for supporting a dowel or peg centered at the vertex of the two planar surfaces.

8. A process for shaving a peg or dowel comprising placing a peg or dowel in a V-shaped groove provided in a side of a stationary block, fitting an opposing movable block with a cutterblade such that a beveled edge of the cutterblade overhangs the movable block and is axially aligned with a vertex of the V-shaped groove, rotating adjusting nuts for axially advancing the movable block along guide bolts toward the stationary block until the edge of the cutterblade impinges upon the peg or dowel and rotating the peg or dowel to subject the outer surface of the peg or dowel to the cutting force of the beveled edge.

9. The process of claim 8 further comprising the step of adjusting the position of the cutterblade for providing angular orientation of the beveled edge in relation to the V-shaped groove.

* * * * *